US010551085B2

(12) United States Patent
Santucci

(10) Patent No.: US 10,551,085 B2
(45) Date of Patent: Feb. 4, 2020

(54) EXTRACTION HOOD

(71) Applicant: Whirlpool EMEA S.p.A., Pero (IT)

(72) Inventor: Mauro Santucci, Fabriano (IT)

(73) Assignee: Whirlpool Corporation, Benton Harbor, MI (US)

( * ) Notice: Subject to any disclaimer, the term of this patent is extended or adjusted under 35 U.S.C. 154(b) by 635 days.

(21) Appl. No.: 14/972,456

(22) Filed: Dec. 17, 2015

(65) Prior Publication Data

US 2016/0178233 A1 Jun. 23, 2016

(30) Foreign Application Priority Data

Dec. 22, 2014 (IT) ..... TO2014A1085

(51) Int. Cl.

| | |
|---|---|
| ***F24F 13/10*** | (2006.01) |
| ***F24C 15/20*** | (2006.01) |
| ***F04D 25/08*** | (2006.01) |
| ***F04D 25/14*** | (2006.01) |

(52) U.S. Cl.
CPC ..... *F24F 13/10* (2013.01)

(58) Field of Classification Search
CPC ..... F04D 25/08; F04D 25/14; F24C 15/2021; F24F 13/10
See application file for complete search history.

(56) References Cited

U.S. PATENT DOCUMENTS 1,743,731 A * 1/1930 Scott ..... F23L 13/00 126/116 A
2,687,687 A 8/1954 Clark
2,911,900 A * 11/1959 Emil ..... F04D 25/14 454/352
2,924,166 A * 2/1960 Gerlitz ..... F24F 7/025 415/148
3,009,475 A * 11/1961 Richterkessing ..... F16K 1/223 137/512.1
4,079,751 A * 3/1978 Partridge ..... F16K 15/038 137/512.1
4,094,336 A * 6/1978 Urschel ..... F16K 15/038 137/512.1

(Continued)

FOREIGN PATENT DOCUMENTS

CH 598549 A5 * 4/1978 ..... F24F 13/14
CN 103574722 A * 2/2014

(Continued)

OTHER PUBLICATIONS

Italian Search Report dated Sep. 2, 2015 for Italian Application No. TO2014A001085 filed on Dec. 22, 2014, 7 pages.

*Primary Examiner* — Kenneth Rinehart
*Assistant Examiner* — Logan P Jones
(74) *Attorney, Agent, or Firm* — Price Heneveld LLP

(57) ABSTRACT

The present invention relates to a suction device (103) for a hood (101), comprising a motor, and further comprising an impeller driven by the motor and configured to draw an air flow and direct it into an outflow collar (203); the suction device (103) further comprises at least one flap (204, 205) connected to the collar (203) and hinged (301) on one side only, the at least one flap (204, 205) being configured to close the collar (203) when the impeller is idle, and to be lifted by the air flow so as to clear the collar (203) when the impeller is rotating.

20 Claims, 4 Drawing Sheets

(56) References Cited

U.S. PATENT DOCUMENTS

| | | | | | |
|---|---|---|---|---|---|
| 4,406,216 | A * | 9/1983 | Hott | F24F 7/013 | 248/343 |
| 4,779,518 | A * | 10/1988 | Artwick | F24F 7/013 | 16/360 |
| 4,977,926 | A * | 12/1990 | Hocking | A47B 96/068 | 137/512.1 |
| 9,109,810 | B2 * | 8/2015 | Dominiak | F01D 25/12 | |
| 9,157,453 | B2 * | 10/2015 | Wenger | F04D 25/08 | |

FOREIGN PATENT DOCUMENTS

| | | | | |
|---|---|---|---|---|
| DE | 89 10 466 | U1 | 10/1989 | |
| DE | 10151584 | A1 * | 6/2002 | A62C 4/00 |
| DE | 10245403 | B3 * | 4/2004 | F16K 15/038 |
| EP | 1835239 | A2 * | 9/2007 | F04D 19/002 |
| GB | 1076671 | A * | 7/1967 | F16K 15/036 |
| GB | 1079011 | A * | 8/1967 | F24F 7/025 |

* cited by examiner

EXTRACTION HOOD

CROSS REFERENCE TO RELATED APPLICATIONS

This application claims priority to Italian Application No. TO2014A001085, filed on Dec. 22, 2014, the content of which is hereby incorporated by reference in its entirety.

TECHNICAL FIELD

The present invention relates to the field of hoods, in particular for treating fumes and odours in household environments, e.g. range hoods.

The invention relates in particular to a suction device for a hood, as well as to an associated range hood.

PRIOR ART

Aspirating and/or filtering devices are known which are to be installed near places where fumes or odours are generated. For example, such aspirating and/or filtering devices are called "hoods" and are typically installed in household environments, such as a kitchen.

Some hoods take in fumes from the environment, discharging the aspirated air into a ventilation duct, which then evacuates both fumes and odours out in the open; such hoods are hence referred to as "extraction hoods".

Other hoods collect fumes from the environment, filter them, and then reintroduce the air thus purified into the same environment; hoods of this latter type are referred to as "recirculating hoods".

The hoods known in the art comprise one or more suction devices, typically consisting of a compressor or a fan wherein a motor (typically an electric motor) drives an impeller, which provides an air volume with a certain head, thereby increasing its pressure for moving it within a duct.

Known hoods comprise an air inlet opening connected to a chimney-type extraction element, and between the opening and the extraction element the suction device is inserted, which ensures proper operation of the hood.

Suction devices are therefore fundamental components of hoods, but unfortunately the hoods known in the art suffer from a number of problems related to their suction devices.

As a matter of fact, the suction devices known in the art are an integral part of the circuit for the air aspirated by the hood: when such devices are on, they contribute to the proper operation of the hood; however, when the suction devices are off, they are substantially passive elements exposed to undesired backflows of fluid coming from other ducts of the hood.

Moreover, when they are off, the suction devices known in the art are exposed to external disturbances such as dust or insects, which may go back down the hood's extraction tube, thus fouling and obstructing the impeller of the suction device and preventing it from working properly.

OBJECTS AND SUMMARY OF THE INVENTION

It is the object of the present invention to overcome some of the problems of the prior art.

In particular, it is one object of the present invention to provide a suction device for a hood which is more effective in both the on and off conditions.

It is another object of the present invention to provide a suction device for a hood which is less exposed to external disturbances, in particular coming from the extraction tube of the hood with which the suction device is associated.

It is a further object of the present invention to provide a suction device for a hood which is simpler to assemble and to install.

These and other objects of the present invention are achieved through a range hood incorporating the features set out in the appended claims, which are an integral part of the present description.

A basic idea of the present invention is to provide a suction device for a hood, which comprises a motor and an impeller driven by the motor for drawing an air flow and directing it into an outflow collar; the suction device further comprises at least one flap connected to the collar and hinged on one side only, the flap being configured to close the collar when the impeller is idle, and to be lifted by the air flow so as to clear the collar when the impeller is rotating.

Such a solution allows providing the suction device with a self-closing collar, so as to prevent any backflow from the collar to the impeller when the latter is idle. In this manner, (cold) air backflow into the environment where the hood is installed is prevented when the suction device is off, while also avoiding that insects, dusts or the like might run back down the extraction tube into the collar, with the risk of fouling and obstructing the impeller. Thus, the suction device will also be less exposed to external disturbances, resulting in a more reliable device.

In other words, this solution allows both the suction device and the upstream household environment, i.e. the environment where the hood is installed, to be effectively insulated from the outside environment, i.e. the environment downstream of the extraction tube of the hood.

Preferably, the collar has a circular section, and the device comprises a first flap having a semicircular shape and a second flap, also having a semicircular shape, cooperating with the first flap in order to close the collar when the impeller is idle; the first flap and the second flap are hinged on respective sides contiguous to each other, arranged diametrically on the collar, so as to be lifted, preferably in a symmetrical manner, when hit by the air flow. Thus, a suction device can be provided wherein the collar can be effectively closed, when the device is idle, by two flaps which cooperate together and which are easy to assemble and install into the device, since they are hinged in an advantageously simple and effective manner.

Preferably, the first flap and the second flap comprise respective pivot pins inserted in respective slots formed on the collar; the pivot pins comprise at least one abutment element for each flap, shaped like a cylindrical sector and configured to create a shape fitting with the respective abutment element of the other flap, so as to counter-rotate as the first flap and second flap rise. Thus, both flaps will rise while being guided and adhering together, thanks to the cooperation of the abutment elements, so that the two flaps will not interfere with each other, resulting in less noise and vibration as the flaps rise.

Preferably, each one of the slots formed on the collar is obtained by the union of two semi-slots, each one respectively formed on the collar of one of the two semi-shells constituting the volute of the suction device. Advantageously, given the direction of penetration of the mould used for making each one of the semi-shells, each semi-slot is obtained during the same movement of the mould for making the entire semi-shell, leading to clear advantages in terms of simplicity of the production cycle and cost of the mould itself.

Preferably, in the suction device the first flap and the second flap are identical, resulting in significant cost savings and easier assembly, since the two flaps are de facto perfectly interchangeable.

Preferably, the at least one flap comprises a closing counterweight that advantageously fosters the closing of the flap by gravity for obstructing the collar when the impeller is idle.

Furthermore, when two flaps are used, preferably the first flap comprises a first closing counterweight and the second flap comprises a second closing counterweight, the counterweights being non-aligned with respect to the opening direction, so that advantageously the flaps will not interfere with each other when they are lifted by the air flow.

Preferably, the collar further comprises at least one stopping element configured to limit the opening movement of the flap. The closing movement of the flap will thus be easier and quicker when the impeller is idle, preventing flap jamming problems.

In particular, the stopping element is preferably configured to allow an opening movement of the flap of less than 90°—more preferably between 75° and 85°—relative to the idle position. This will prevent the open flaps from vibrating under the action of the air flow, and the flaps will close back more easily because each flap will return by gravity into the idle position.

Preferably, the collar further comprises at least one resting element advantageously configured to bear the flap in the idle position, thus improving its opening action when the suction device is turned on again and preventing any jamming or blockage.

Preferably, the flap comprises a shaped aerodynamic surface with a curvature, adapted to avoid the onset of vibrations that would occur if the flap were flat, and also adapted to be more easily lifted by the air flow.

The present invention also relates to an associated range hood in which the suction device is installed.

Further objects and advantages of the present invention will become more apparent from the following detailed description and from the annexed drawings.

BRIEF DESCRIPTION OF THE DRAWINGS

Some preferred and advantageous embodiments will now be described by way of non-limiting example with reference to the annexed drawings, wherein.

The drawings show different aspects and embodiments of the present invention and, where appropriate, similar structures, components, materials and/or elements in the various drawings are designated by the same reference numerals.

DETAILED DESCRIPTION OF THE INVENTION

Figure 1:
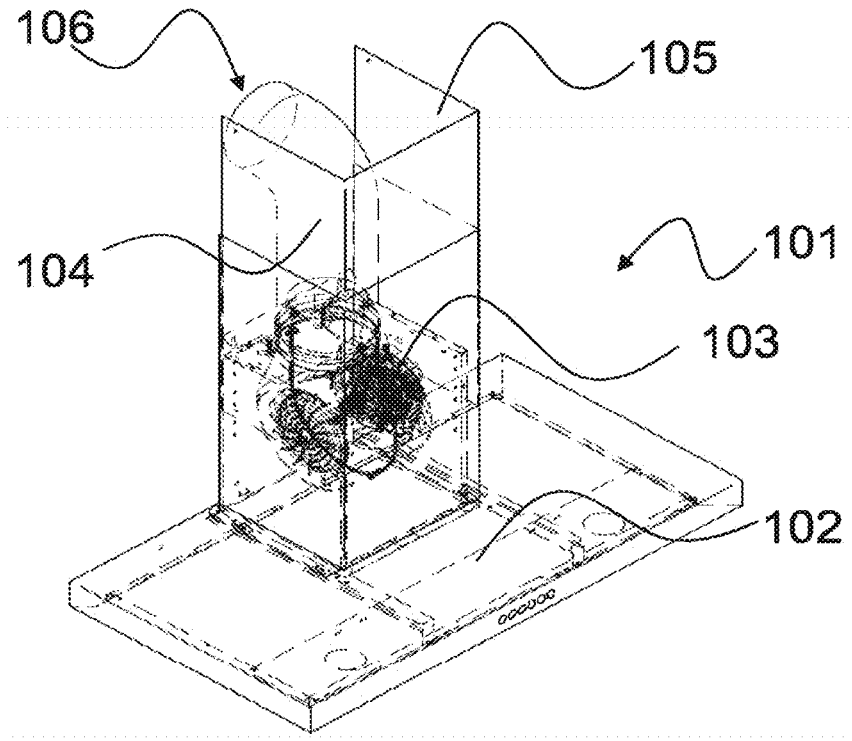
FIG. 1 exemplifies a hood according to the present invention.

FIG. 1 shows one example of a range hood 101 of the extraction type, preferably wall-mounted. In alternative embodiments, the range hood may be, for example, of the "island" type, i.e. installed away from the walls of the room and accessible on all four sides.

In general, the present invention finds a particularly advantageous application in extraction hoods; nevertheless, the present invention may also be applied to recirculating hoods.

The hood 101 comprises a fume collector 102, which is typically positioned above a cooking top; the fume collector 102 may comprise further filter elements (not shown) for filtering airborne greasy particles, consisting of filters in accordance with the teachings of the prior art.

The hood 101 further comprises a suction device 103, adapted to collect air from the fume collector 102 and direct it into the extraction tube 104, as will be described more in detail below.

Preferably, the extraction tube 104 is masked by the aesthetic cover 105, which hides it from view to any users in the room where the hood 101 is located.

At the outlet of the extraction tube 104, i.e. at the top of the hood 101, there is a discharge section 106, such as a wall-mounted flange, which is typically available in the wall of the household environment where the hood 101 is installed.

In general, the present invention is applicable to any type of hood or suction system that includes a suction device, as will be described below.

Figure 2:
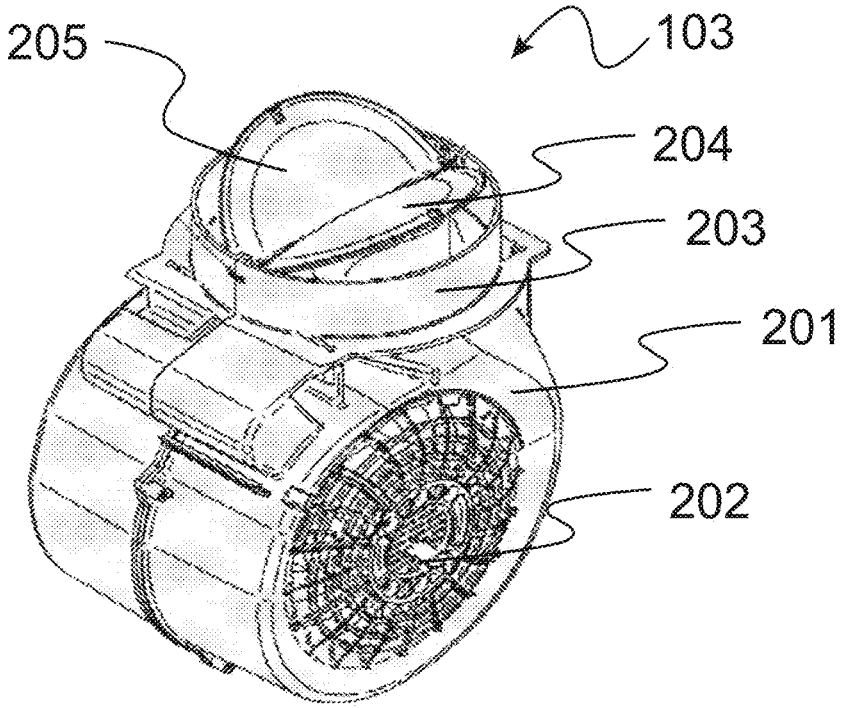
FIG. 2 shows in more detail a suction device for a hood according to the present invention.

FIG. 2 illustrates in more detail the suction device 103.

The suction device 103 comprises a volute 201, which houses a motor and an impeller driven by the motor (not shown). The motor is typically an electric motor. The impeller is configured to take in an air flow from a grid 202 and direct it into the outflow collar 203. The outflow collar 203 is configured to be put in fluidic communication with the extraction tube 104 of the hood 101, whereas the grid 202 takes in the air coming from the fume collector 102. The outflow collar (or flange) is typically vertical and connects directly to the extraction tube 104.

In general, the motor and the impeller of the suction device 103 can be designed in many ways per se known to those skilled in the art, in particular as regards the field of centrifugal fans with axial intake.

The suction device comprises at least one flap, preferably two flaps 204 and 205, mechanically connected to the collar 203, in particular hinged thereto, so that they can open and close simultaneously.

In particular, each one of the flaps 204 and 205 is hinged and connected to the collar 203 on one side only, thus being able to rotate about that side in order to perform the functions described below.

In the present description, the term "flap" has the common meaning of "flat and thin piece, connected on one side to another element, so that it can easily move".

The flaps 204 and 205 are configured to obstruct the free section of the collar 203 when they sit low in the collar, with the impeller off, and to rise automatically, thereby clearing the collar 203, when they are hit by the air flow created by the impeller, with the impeller on and turning.

The suction device 103 is therefore self-closing, i.e. it can obstruct the collar 203 by means of the flaps 204 and 205 when the impeller is not turning. Thus, when the impeller is off, external air—cold air in winter—will be prevented from entering the collar, just like any other thing, such as dust or debris, or even small animals.

The two flaps 204 and 205 are preferably made of plastic, e.g. polypropylene; therefore, they are light and can be opened by the outflowing air, and then close again by gravity when the air flow stops.

Therefore, the suction device 103 allows providing a simple self-closing outflow collar that requires low production costs and short installation times.

Figure 3:
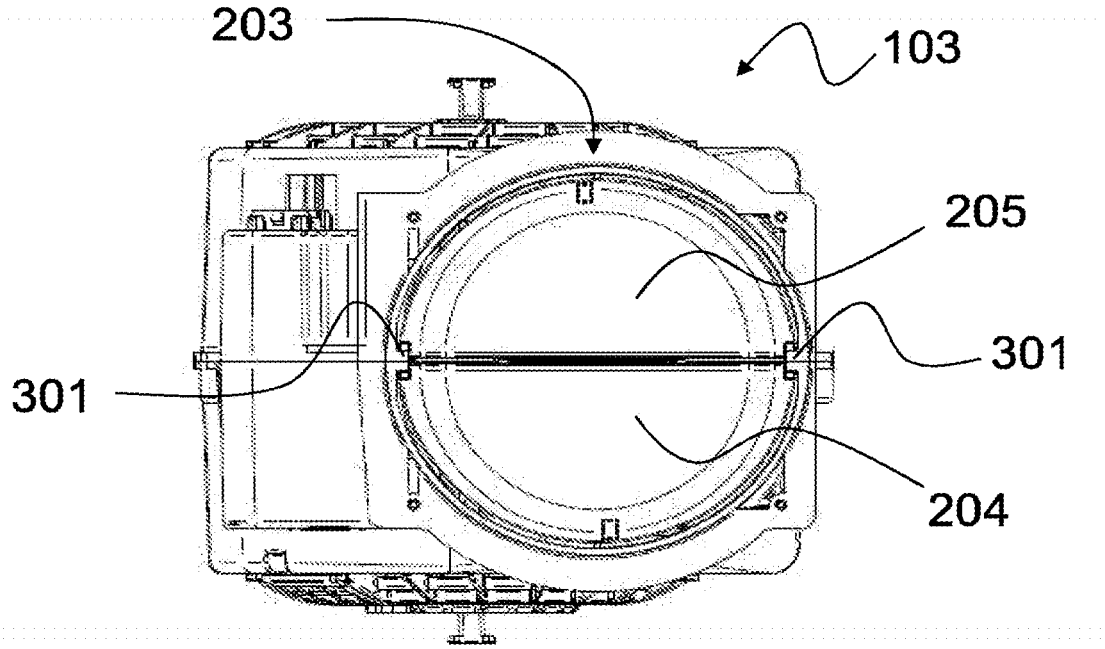
FIG. 3 shows a top view of the suction device for a hood of FIG. 2, in the closed configuration.

FIG. 3 shows a top view of the suction device 103, in the closed configuration. In this view one can appreciate that the flaps 204 and 205 cooperate together to completely obstruct the collar. In fact, the flaps 204 and 205 are semi-circular and, advantageously, geometrically identical; the collar 203 has a circular shape, so that the two flaps 204 and 205 can obstruct the entire section thereof, since their total diameter is only slightly smaller than that of the collar 203.

It should be reminded that, in mathematics, the semicircular shape, or semicircle, is that bidimensional geometrical figure that represents one half of a circle, thus forming a 180° arc, wherein the chord coincides with the circumference diameter.

The flaps 204 and 205 are hinged on respective sides contiguous to each other along the diameter of the collar 203, in the regions designated by reference numeral 301, which are diametrically opposite on the collar 203. Thus, the flaps 204 and 205 will rise when they are hit by the air flowing through the collar 203.

Figure 4:
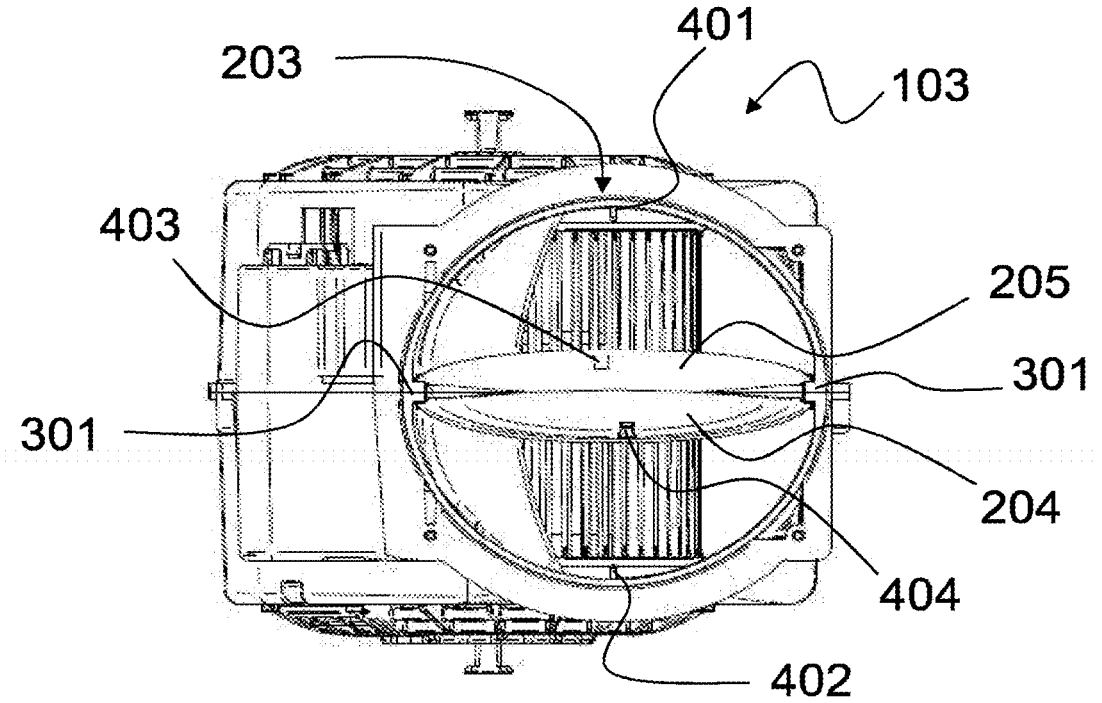
FIG. 4 shows a top view of the suction device for a hood of FIG. 2, in the open configuration.

FIG. 4 shows a top view of the suction device 103, in the open configuration, with the flaps 204 and 205 being lifted by the air flowing through the collar 203.

In this view, one can see the abutment elements 401 and 402, whereon the flaps 204 and 205 are configured to rest when they are lowered in the idle position.

Moreover, each one of the two flaps 204 and 205 comprises a respective closing counterweight 403 and 404, preferably positioned in proximity to the free end of the flap, i.e. the end opposite to the pivot pins, thus generating by gravity a moment relative to the axis of rotation of the flap, which acts upon the flap so as to close it.

The closing counterweights 403 and 404 are preferably obtained by accumulating material during the flap moulding process and concentrating it at a given point of the flap surface.

The closing counterweights 403 and 404 are adapted to foster the closing of the flaps 204 and 205, in particular to bring them back, by gravity, onto the abutment elements 401 and 402 that support them. Thus, the closing counterweights 403 and 404 are adapted to keep the collar 203 closed in a more effective manner, as shown in FIG. 3.

In particular, the counterweight 403 and the counterweight 404 are slightly offset with respect to the opening direction of the flaps (transversal to the hinges), so that the counterweights will not hit and interfere with each other, even when the flaps are lifted by the air flow.

As can be seen, the flaps 403 and 404 are preferably identical, with the same shape and arrangement of the various elements, resulting in lower production costs.

Figure 5:
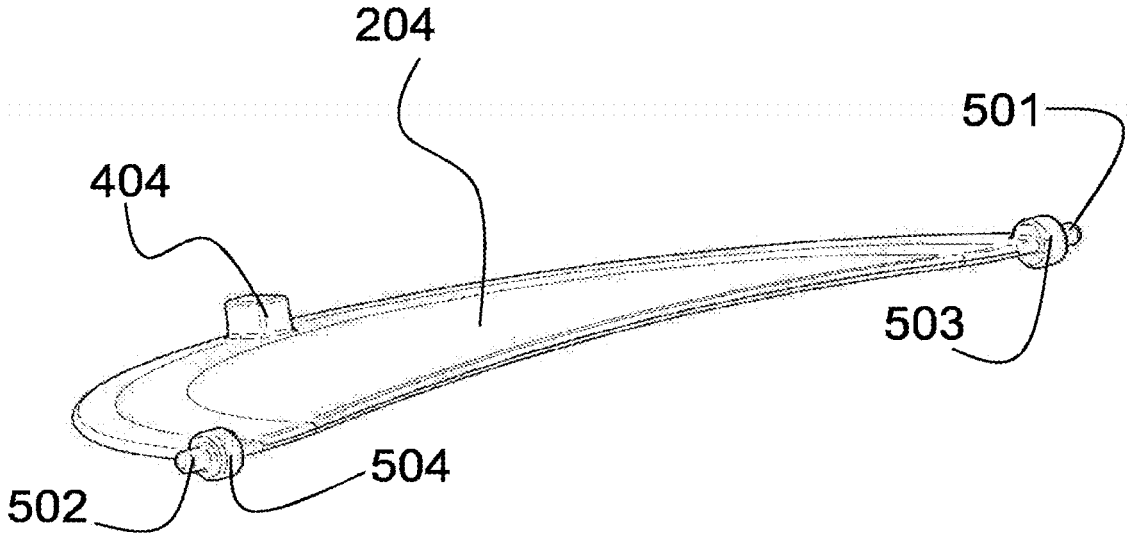
FIG. 5 shows a detail of a flap included in a suction device according to the present invention.

FIG. 5 illustrates in detail the flap 204, which, as aforesaid, is preferably identical to the flap 205.

The flap 204 comprises an aerodynamic surface with a curvature, as shown, that allows it to be easily lifted by the air flow through the collar 203.

In addition, the flap 204 comprises, on the side whereon it is hinged, a pair of respective pins 501 and 502, adapted to be inserted into holes or slots formed on the collar 203, so that the flap will be able to rotate about them.

Furthermore, the flap 204 preferably comprises, in a slightly more inward position compared to the pins 501 and 502, respective abutment elements 503 and 504 shaped like a cylindrical sector, the operation of which will be explained below.

Figure 6:
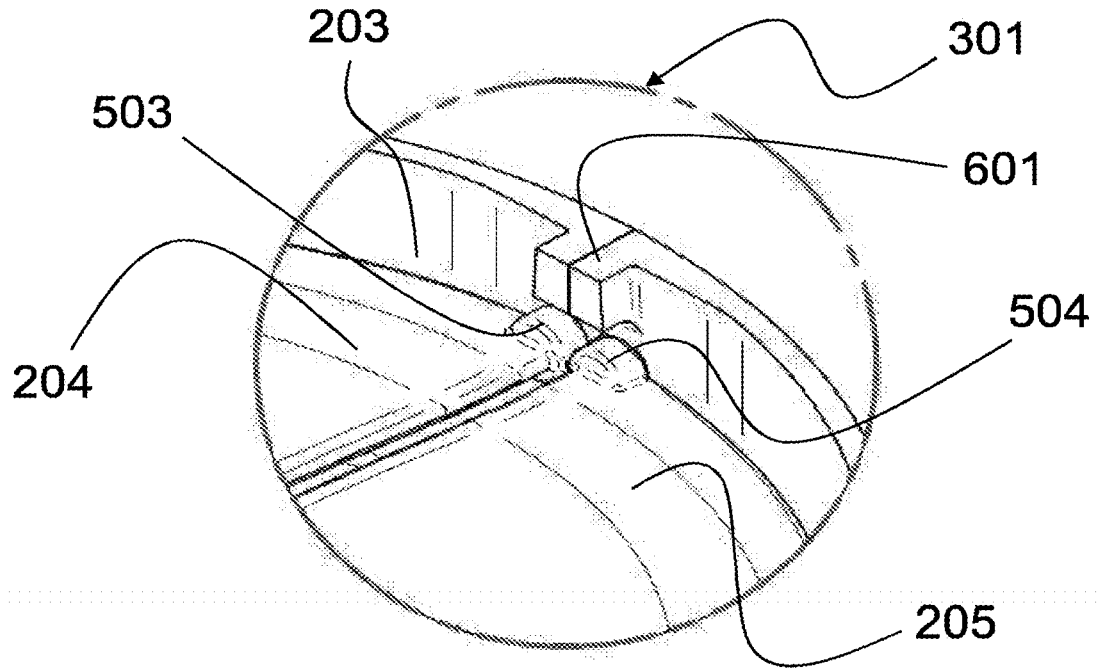
FIG. 6 shows in detail the assembly of the flaps in a suction device according to the present invention.

FIG. 6 illustrates in detail how the flaps 204 and 205 are assembled into the collar 203 of the suction device 103.

The two pivot pins 501 and 502 at the lateral ends of the flaps are inserted into suitable slots formed on the collar 203 (not shown in the drawing).

The abutment elements 503 and 504 are configured to create a shape fitting with the respective abutment elements of the other flap, being advantageously shaped like a cylindrical sector so that they will counter-rotate when the flaps rise, thus imposing a rotational constraint that will cause them to rise together.

Moreover, since the abutment elements put the flaps in contact with each other, they will cause the respective axes of rotation to remain fixed in space as the flaps rise, notwithstanding the fact that the pins are both housed in a single slot as opposed to individual holes.

In one possible variant of the invention, the abutment elements 503 and 504 may comprise abutment surfaces having gear-like profiles with respective pluralities of meshable teeth; in this case, the shape fitting between the gears will still impose a rotational constraint that will cause the flaps to rise together, thus making their opening action more regular.

The collar 203 further comprises a stopping element 601 configured to limit the opening movement of the flaps, as will be described below.

Figure 7:
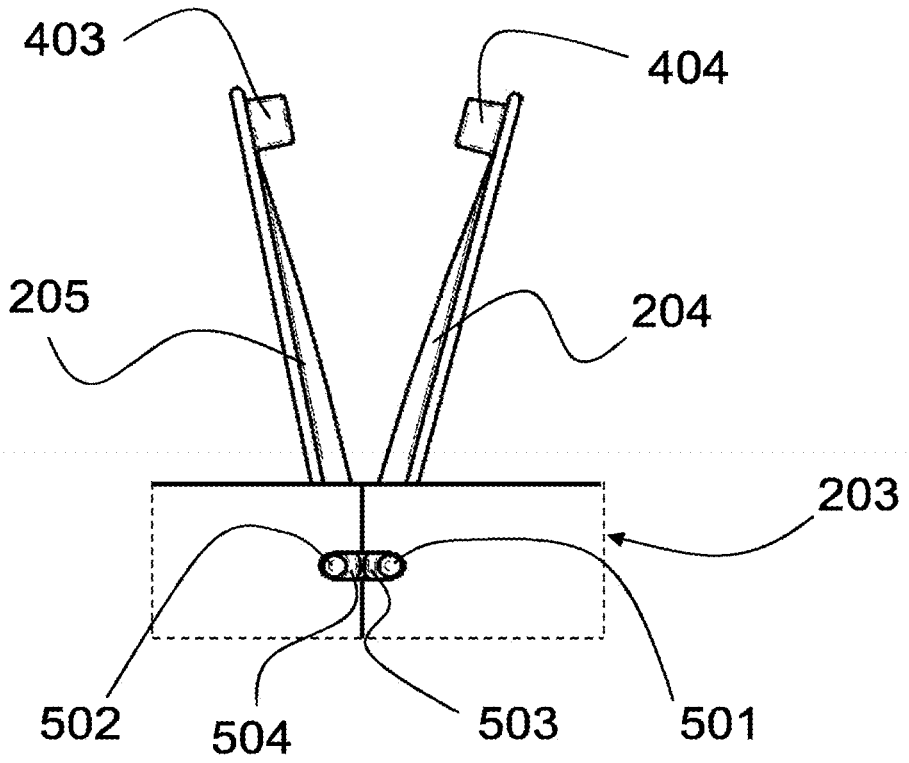
FIG. 7 exemplifies the operation of a suction device according to the present invention.

FIG. 7 exemplifies the operation of the suction device 103.

As aforesaid, the abutment elements 503 and 504 constitute extensions shaped like cylindrical sectors, located more inward than the pins, and configured to cause the flaps to rotate in adherence to each other, thereby avoiding vibration and noise, without the flaps interfering with each other.

The contact between the two flaps, obtained by means of the abutment elements 503 and 504, will cause the axes of rotation of the two flaps 204 and 205 to remain fixed, notwithstanding the presence, on each side of the collar 203, of a single elongated slot instead of a pair of circular holes. In fact, in order to reduce the production costs, each slot is formed by the union of two semi-slots, each one respectively formed on the collar part of one semi-shell constituting the volute of the suction device, as highlighted by the moulding lines particularly visible in FIGS. 2, 3 *e* 4.

Thus, the pins can turn about the outer edges of the slots of the collar without translating, while the two abutment elements adhere to each other as they rotate.

The above-described stopping element 601 allows limiting the maximum opening of the flaps relative to their idle position (i.e. the horizontal line in the drawing). In particular, said stopping element 601 is configured to allow a maximum opening angle of less than 90°, preferably between 75° and 85°, more preferably between 80° and 85°.

In this manner, the gravity acting upon the counterweights 404 and 405 of the flaps—which remain slightly open—contributes to causing the flaps 204 and 205 to close more quickly when the air stops flowing through the collar 203.

The stopping element 601 consists of an internal protuberance of the collar 203, and is therefore also useful for preventing the flaps from vibrating or fluttering against each other.

It is obvious that, in the light of the teachings of the present description, the man skilled in the art may conceive further variants of the present invention, without however departing from the protection scope as defined by the appended claims.

For example, in suction devices equipped with collars having diversified shapes, one or more liftable flaps of diversified shapes may be fitted, configured to obstruct the collar in the idle condition.

In general, the construction details provided merely by way of example in the present description can be modified by the man skilled in the art in accordance with prior-art teachings. In particular, a range hood according to the present invention may use prior-art teachings as far as materials, construction details, equipment and functions are concerned: all the general aspects of the range hood, whether or not described herein, may therefore vary, provided that they are not in conflict with the teachings of the present invention.

The invention claimed is:

1. A suction device for a hood, the suction device comprising:

an outflow collar defining an opening through which air flow is directed, the outflow collar having a stopping element being a protuberance extending inwardly toward a center of the opening defined by the outflow collar;

a motor;

an impeller driven by the motor and configured to draw the air flow and direct it into the opening defined by the outflow collar;

first and second flaps connected and hinged to the outflow collar on one side only of the first and second flaps, the first and second flaps being configured to close the outflow collar when the impeller is idle, and to be lifted by the air flow so as to clear the outflow collar when the impeller is rotating, wherein the stopping element, that is the protuberance extending inwardly toward the center of the opening defined by the outflow collar, is configured to contact the first and second flaps to limit an opening movement of the first and second flaps, wherein the first flap includes a first pivot pin and the second flap includes a second pivot pin, wherein the first pivot pin and the second pivot pin are inserted in respective slots formed on the outflow collar, and wherein the outflow collar includes a pair of slots, each one of the slots housing a pair of the pivot pins, wherein each one of the slots is formed by the union of two semi-slots, each one respectively formed on the outflow collar of a respective one of two semi-shells constituting a volute of the suction device; and at least one abutment element of the first and second flaps located under the stopping element of the outflow collar and configured to provide a rotational constraint to the first and second flaps.

2. The suction device according to claim 1, wherein the collar has a circular section, and wherein the first flap has a semicircular shape, wherein the second flap has a semicircular shape and is configured to cooperate with the first flap to close the collar when the impeller is idle, and wherein the first flap and the second flap are hinged on respective sides contiguous to each other and arranged diametrically on the outflow collar, so as to be lifted when hit by the air flow.

3. The suction device according to claim 2, wherein the first pivot pin includes the at least one abutment element, shaped like a cylindrical sector, for the first flap, the at least one abutment element being configured to create a shape fitting with a different abutment element of the second flap, so as to counter-rotate as the first flap and the second flap rise.

4. The suction device according to claim 2, wherein the first flap and the second flap are identical.

5. The suction device according to claim 1, wherein each of the first and second flaps includes a closing counterweight adapted to foster the closing of the first and second flaps in order to obstruct the outflow collar when the impeller is idle.

6. The suction device according to claim 5, wherein the first flap includes a first closing counterweight and the second flap includes a second closing counterweight, the first counterweight and the second counterweight being non-aligned with respect to an opening direction of the first flap and of the second flap, so as not to interfere with each other when lifted by the air flow.

7. The suction device according to claim 1, wherein the stopping element is configured to allow a maximum opening angle of the first and second flaps of less than 90° relative to the position of the first and second flaps when the impeller is idle, respectively.

8. The suction device according to claim 1, wherein the outflow collar includes at least one resting element configured to bear at least one of the first and second flaps in a lowered position when the impeller is idle.

9. The suction device according to claim 1, wherein each of the first and second flaps includes a shaped aerodynamic surface with a curvature.

10. A range hood, comprising:

a suction device, wherein the suction device includes:

an outflow collar having a circular section and defining an opening through which air flow is directed, the outflow collar having a first stopping element and a second stopping element adjacent to each other and being protuberances extending inwardly toward a center of the opening defined by the outflow collar;

a motor;

an impeller driven by the motor and configured to draw the air flow and direct it into the opening defined by the outflow collar having the circular section;

a first flap and a second flap each connected to and hinged to the outflow collar via first and second pins positioned in respective slots defined by the outflow collar, wherein the slots are defined by a union of two semi-slots respectively formed on a collar part of a respective one of two semi-shells forming a volute, the first flap and the second flap each having a semicircular shape and each being configured to close the collar when the impeller is idle, and to be lifted by the air flow so as to clear the collar when the impeller is rotating, and wherein the first stopping element, that is the protuberance extending inwardly toward the center of the opening defined by the outflow collar, is configured to limit a first opening movement of the first flap and the second stopping element, that is the protuberance extending inwardly toward the center of the opening defined by the outflow collar, is configured to limit a second opening movement of the second flap; and a first abutment element of the first flap located under the first stopping element of the outflow collar and configured to contact a second abutment element of the second flap located under the second stopping element, wherein the first abutment element and the second abutment element counter-rotate when the first flap and the second flap rise.

11. The suction device according to claim 3, wherein the first flap and the second flap are identical.

12. The suction device according to claim 1, wherein the first flap and the second flap are identical.

13. The suction device according to claim 2, wherein the at least one flap includes a closing counterweight adapted to foster the closing of the at least one flap in order to obstruct the outflow collar when the impeller is idle.

14. The suction device according to claim 2, wherein the outflow collar includes at least one resting element configured to bear at least one of the first and second flaps in a lowered position when the impeller is idle.

15. The suction device according to claim 3, wherein the outflow collar includes at least one resting element configured to bear at least one of the first and second flaps in a lowered position when the impeller is idle.

16. A suction device for a hood, the suction device comprising:

a volute including two semi-shells each having a collar part cooperating to form an outflow collar, wherein the outflow collar defines an opening through which air flow is directed, the outflow collar having a first stopping element and a second stopping element adjacent to each other and being protuberances extending inwardly toward a center of the opening defined by the outflow collar;

a motor;

an impeller driven by the motor and configured to draw the air flow and direct it into the opening defined by the outflow collar; and a first flap having a first linear surface and a second flap having a second linear surface, each of the first flap and the second flap connected to and hinged to the outflow collar on one side of the first flap and the second flap, the first flap and the second flap being configured to close the outflow collar when the impeller is idle, and to be lifted by the air flow so as to clear the outflow collar when the impeller is rotating, and wherein the first stopping element, that is the protuberances extending inwardly toward the center of the opening defined by the outflow collar, is configured to limit a first opening movement of the first flap and the second stopping element, that is the protuberance extending inwardly toward the center of the opening defined by the outflow collar, is configured to limit a second opening movement of the second flap;

wherein the first flap includes a first pivot pin and the second flap includes a second pivot pin, wherein the first pivot pin and the second pivot pin are inserted in respective slots formed on the outflow collar, wherein the first pivot pin includes a first abutment element being configured to create a shape fitting with a second abutment element of the second flap, so as to counter-rotate as the first flap and the second flap rise, and wherein each of the respective slots is formed by a union of the two semi-slots and each of the semi-slots are defined by collar parts of a respective one of the two semi-shells.

17. The suction device according to claim 1, wherein the outflow collar has a circular section, and wherein the first flap has a semicircular shape and the second flap has a semicircular shape.

18. The suction device according to claim 17, wherein the first flap includes a first closing counterweight and the second flap includes a second closing counterweight, the first counterweight and the second counterweight being non-aligned with respect to an opening direction of the first flap and of the second flap, so as not to interfere with each other when lifted by the air flow.

19. The suction device according to claim 1, wherein each of the first and second flaps includes a surface that makes contact with the stopping element.

20. The suction device according to claim 19, wherein each of the surface first and second flaps includes a linear surface that makes contact with the stopping element, wherein the protuberance extending inwardly toward the center of the opening defined by the outflow collar limits an opening movement of the first and second flaps.

* * * * *